US007350560B2

(12) United States Patent
Grobelny et al.

(10) Patent No.: US 7,350,560 B2
(45) Date of Patent: Apr. 1, 2008

(54) HEAT EXCHANGERS

(75) Inventors: Günter Grobelny, Herne (DE); Walter Schwarzer, Dülmen (DE)

(73) Assignee: Balcke-Durr GmbH, Ratingen (DE)

( * ) Notice: Subject to any disclaimer, the term of this patent is extended or adjusted under 35 U.S.C. 154(b) by 596 days.

(21) Appl. No.: 10/916,412

(22) Filed: Aug. 12, 2004

(65) Prior Publication Data

US 2005/0067148 A1 Mar. 31, 2005

(30) Foreign Application Priority Data

Aug. 21, 2003 (EP) ..... 03018961

(51) Int. Cl.
*F16L 11/02* (2006.01)

(52) U.S. Cl. ..... 165/71; 165/159

(58) Field of Classification Search ..... 165/71, 165/158–162

See application file for complete search history.

(56) References Cited

U.S. PATENT DOCUMENTS 2,547,393 A * 4/1951 Huzenlaub et al. ..... 34/92
3,795,273 A * 3/1974 Brigida et al. ..... 165/112
4,219,077 A * 8/1980 Furukawa et al. ..... 165/114
4,224,981 A 9/1980 Datz et al. ..... 165/114
4,226,283 A * 10/1980 Furukawa et al. ..... 165/114
4,461,346 A * 7/1984 Hoshino et al. ..... 165/114

FOREIGN PATENT DOCUMENTS

DE 1098954 2/1961

* cited by examiner

*Primary Examiner*—Allen J. Flanigan
(74) *Attorney, Agent, or Firm*—Baker & Hostetler LLP

(57) ABSTRACT

The invention concerns a heat exchanger with a large number of U-shaped tubes (3), preferably brought together to form at least one tubular bundle and arranged in a housing 2, and several partitions (4) subdividing the housing (2) into separate sections (5). For the formation of a heat exchanger which has a comparatively high efficiency even with increasing operation time, a heat exchanger is proposed in the invention that is characterized by at least one venting tube (6) that preferably extends through all sections (5) of the housing (2) and that has a number of venting holes (15) formed transversely to the longitudinal extension (14) of the tube.

4 Claims, 2 Drawing Sheets

Fig.1
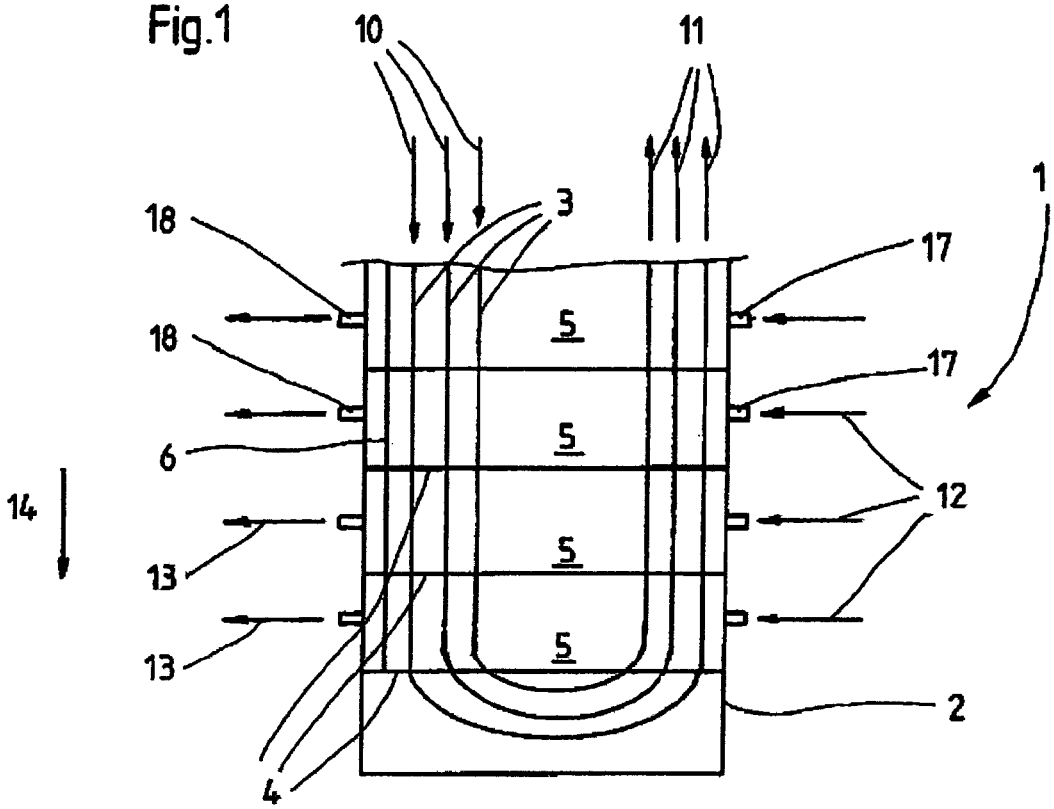
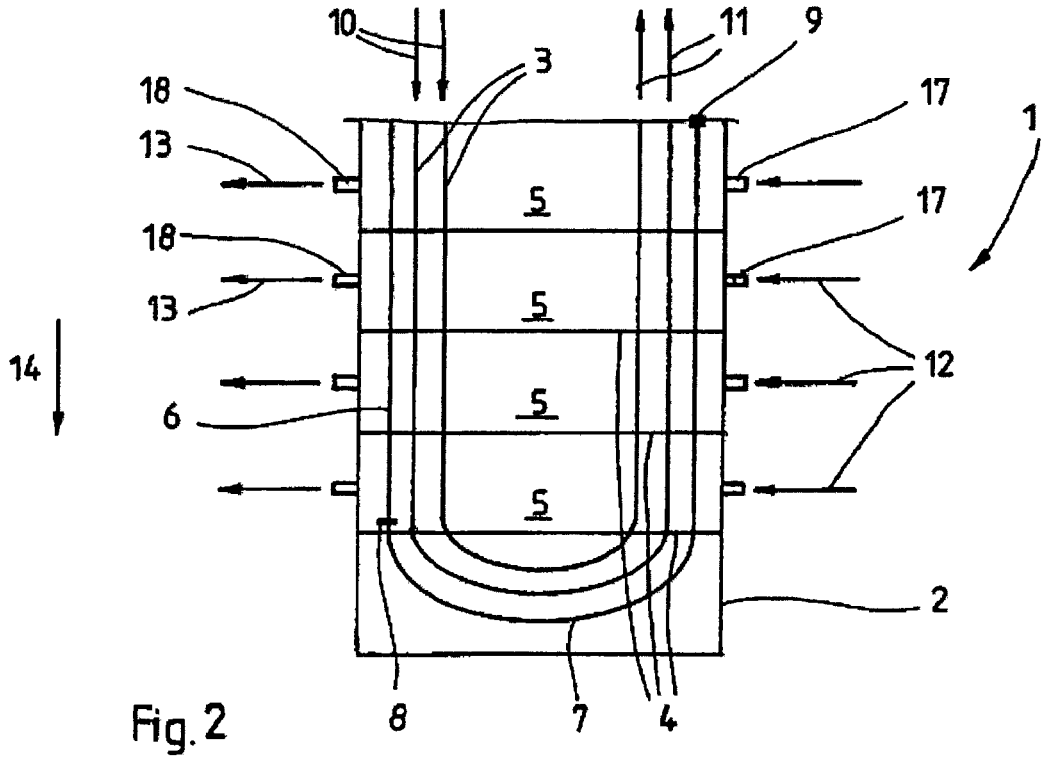
Fig. 2

Fig.3
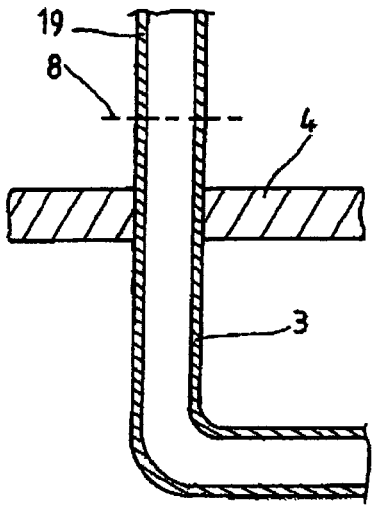
Fig.4
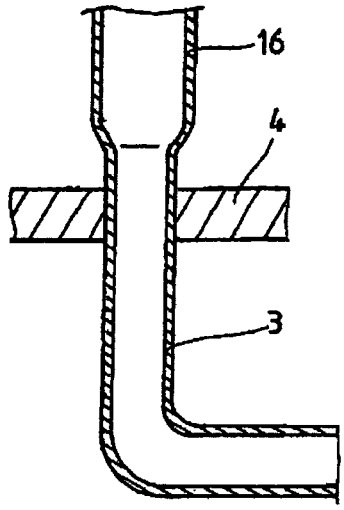
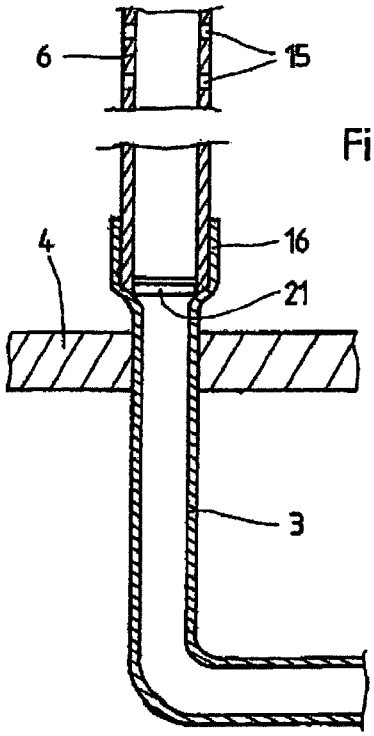
Fig.5
Fig.6
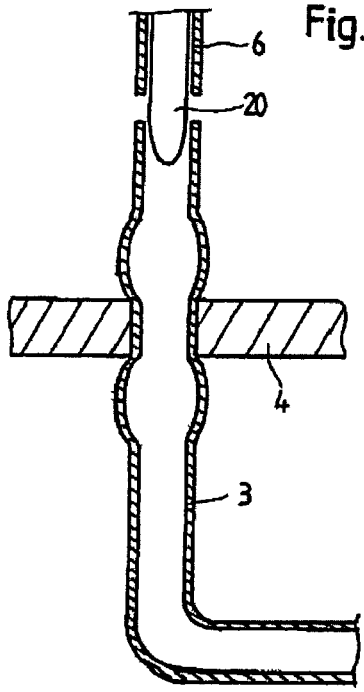

HEAT EXCHANGERS

FIELD OF THE INVENTION

The invention concerns a heat exchanger with a large number of tubes, brought together to form at least one tubular bundle and arranged in a housing, and several partitions subdividing the housing into separate areas.

BACKGROUND OF THE INVENTION

Heat exchangers of the aforementioned type are known from the prior art and are generally designated as tubular heat exchangers. They are used for heat exchange between two media of different temperature, wherein one medium is conducted into the tubes, mostly brought together as tubular bundles and forming a U, and the other medium is conducted past the tubes of the heat exchanger in a flow that is transverse or longitudinal thereto. A highly heated fluid for the most part in the form of water vapor, water, or inert gas, is used as a second medium from which the heat is removed that is intended to be transferred to the first medium conducted through the tubes.

Preferably, the housing that holds the tubes of the heat exchanger has a number of partitions, and housing sections are formed as the result of their arrangement. The partitions, moreover, serve to secure the position and for a dimensionally stable arrangement of the heat transfer tubes located in the housing of the heat exchanger.

A disadvantage has become evident, however, in that the second medium, conducted through the individual housing sections for heat exchange, cannot be conducted out of the individual housing sections without leaving residue. When using a gaseous fluid in particular, condensable residues in the form of gas bubbles can form that concentrate from the outside in nonaccessible places in the housing—that is, accumulate. As a result, with continued operation of the heat exchanger, the surface originally made available for heat exchange by the heat exchanger tubes is no longer completely utilized since the accumulated fluid residues surround the individual heat exchanger tubes like an insulator. Also, residues form in particular in the area of the partitions, so that as operating time of the heat exchanger increases, insulation layers can be regularly formed that can lower the efficiency of the heat exchanger—sometimes, considerably. Thus, performance losses of up to 50% have been found in operating heat exchangers.

SUMMARY OF THE INVENTION

The problem of the invention is therefore to make available an improved heat exchanger that overcomes the aforementioned disadvantages, and also has a comparatively high degree of movement with increased operation time.

This problem is solved by a heat exchanger of the type described in the beginning, which is characterized by at least one venting tube, preferably projecting through all sections of the housing, which has a number of venting holes formed transversely to the longitudinal extension of the tube.

Unlike traditional heat exchangers, the heat exchanger according to the invention has at least one venting tube. This projects through all sections of the housing, which ensures that venting of the entire housing can be undertaken. The venting tube is formed from a tube adapted in its shape and cross-sectional area to the individual application and which has a number of venting holes formed transversely to the longitudinal extension of the tube. A fluidic connection can thus be simply formed between the individual housing sections and the surroundings of the heat exchanger, so that any accumulated or enclosed fluid residues in the interior of the housing can, if necessary, be completely suctioned off. Thus, the accumulation of impairing gas or vapor residues which impair the performance and thus the efficiency of the exchanger can be advantageously counteracted. Application of the venting tube is thereby easily possible. If the consumer detects a worsening of the heat exchanger efficiency, it is necessary only to turn off operation of the heat exchanger briefly, open the otherwise closed venting tube by means of appropriate fittings, and to suction off fluid residues accumulated in the housing through the venting tube. The venting tube can then be closed once more and operation of the heat exchanger restarted.

According to an alternative embodiment, the heat exchanger has a large number of venting tubes, with at least one venting tube being provided per housing section. By means of this arrangement it is not only possible to obtain an accelerated venting process, but also it can be ensured, with the use of several housing sections sealed off from one another, that a mixing of the media introduced into the individual housing sections occurs. At least one venting tube, which has venting holes only in the housing section assigned to the venting tube, is provided per housing section to be vented. If, for example, a heat exchanger housing is arranged into a total of four subsections, then a total of at least four venting tubes is provided, with each venting tube being used to vent one of the four subsections. Moreover, it is of course possible to provide not just one but rather several venting tubes per section to be vented, with these tubes also being provided with venting holes only in that individual section to be vented.

If the individual subsections of the heat exchanger housing are charged with one and the same medium, or if a possible mixing of the media used is not a concern, then the use of only one venting tube is sufficient under certain circumstances, provided that the venting tube has at least one hole per separate section. With such an embodiment as well, the use of several venting tubes is of course advantageous with respect to an accelerated venting process.

In accordance with another feature of the invention, provision is made that the number of venting holes per venting tube and their individual diameters are designed as a function of the application of the heat exchanger. To optimize the venting process, the number of venting holes and their individual diameters can be varied, wherein the important thing is to position the venting holes with the individually required cross-sections in those sections of the housing to be vented where fluid residues preferentially develop in the form of gas bubbles or the like. On the one hand, such an arrangement ensures that the residues forming in the housing sections can be completely suctioned off, and consequently that a complete venting of the housing can be undertaken; on the other hand, a venting process that is accelerated overall is obtained by the deliberate formation of the venting holes. For a further improvement, moreover, the venting holes can be aligned, which in the context of the invention means that the venting holes are distributed over the effective length of the venting tube such that a residue formation expected for to the application of the heat exchanger can preferably be completely suctioned off in venting of the heat exchanger.

Heat exchangers according to the invention are equipped with a previously described venting tube by the manufacturer. According to a special proposal of the invention, however, incorporation of the venting tube according to the invention can also take place later as a retrofit, wherein dismantling of the heat exchanger or of the pipe line is not necessary. In this connection, according to the invention, a proposal is made for a method to arrange a venting tube in a heat exchanger that has several partitions, wherein a tube originally provided for heat exchange is cut open in the region above the partition situated at the bottom in the longitudinal direction, and the cut-off tube section is removed and is replaced by a venting tube provided with venting holes.

After opening of the heat exchanger water chamber, the tubes provided for the purpose are fixed in a bundle holder; parts of the old tube are cut off in a controlled manner, without damaging the neighboring tubes; the neighboring tubes are inspected for damage; new tubes with a defined perforation are inserted, sealed off against the tube disk, brought together in inner collectors, and conducted outwards by existing or new container connections. For this entire measure, the heat exchanger remains in the power station and need only be moved away. Dismantling of pipe lines is not necessary.

A heat exchanger, retrofitted according to the invention, offers the already mentioned advantages, wherein, unlike the heat exchanger equipped with a venting tube by the manufacturer, provision is made according to the invention for a tube originally provided for heat exchange to be retrofitted and used later as a venting tube. For this purpose, as a function of the application purpose of the heat exchanger, at least one of the preferably U-shaped heat exchange tubes is opened up in the area above the partition located at the bottom in the longitudinal direction. The leg of the U-shaped tube thus detached is then removed and replaced by a venting tube provided with venting holes. This partial section of the U-shaped tube, which then serves as the venting tube, can then be used to vent the heat exchanger in the manner already described. Expediently, the other leg of the U-shaped tube is also detached in a similar fashion and is replaced by a venting tube, or if this should be neither desired nor required, it is sealed off. In any case, however, the U-shaped heat exchanger tube, originally serving as the heat exchange tube is decoupled from the heat exchange circulation.

To positionally secure the arrangement of the venting tube, provision is made, according to another feature of the invention, for the tube which was originally provided for heat exchange to be widened before its separation in the region above the partition. This can preferably be done by means of a probe, by means of which an end widening of the tube section remaining in the heat exchanger can be effected over a defined length. A widening of the tube ensures that the tube section remaining in the heat exchanger does not slip in its position after it is opened up, but rather is held secure in its position. In addition, the tube widening is used to develop a tube holder allowing the venting tube to be introduced. The venting tube can then be introduced and anchored in the tube holder formed in this manner. For this purpose, the tube holder can be designed as a press fit. Other joining possibilities are also suitable, such as cementing.

BRIEF DESCRIPTION OF THE DRAWINGS

Other advantages and features of the invention result from the description with the aid of the attached figures. The figures show the following:

FIG. 1 is a schematic representation of the heat exchanger of the invention according to a first embodiment;

FIG. 2 is a schematic representation of the heat exchanger of the invention according to a second embodiment:

FIG. 3 is a schematic representation of a partial section of a tube originally provided for heat exchange;

FIG. 4 is a schematic representation of a partial section of a tube originally provided for heat exchange, with a widening formed at the end side; and FIG. 5 is a schematic representation of a partial section of a tube provided for heat exchange into which a tube used for venting is introduced;

FIG. 6 is a schematic representation of a partial section of a tube provided for heat exchange into which a tube used for venting is introduced according to an alternative embodiment.

DETAILED DESCRIPTION OF THE INVENTION

The lower partial section of a heat exchanger 1 is shown in a schematic view in FIG. 1. The heat exchanger 1 is formed by a large number of U-shaped tubes 3, brought together to form tubular bundles and arranged in a housing 2. Moreover, several partitions 4 are provided that subdivide the housing 2 into separate sections 5.

A medium that is to be heated flows through the tubes 3; it flows into the tube 3 in the flow direction 10 and again leaves in the flow direction 11. A second medium, which flows transversely to the orientation of tubes 3 through the sections 5 of housing 2 and which again leaves the housing in the flow direction 13 through the outlet openings 6 [sic; 18], is supplied via the inlets 17, which can also be constructed as a centrally constructed individual inlet, in accordance with the flow direction 12, into each partial section 5 of the housing 2. When flowing through the housing 2, the medium conducted through the partial sections 5 releases the heat energy that it carries, in a known manner, to the medium conducted through the tubes 3. It is clear that the second medium can also be introduced into the heat exchanger in a manner other than the one represented in FIG. 1.

In a less advantageous manner, there may be medium residues within the housing 2, that is to say, within the individual sections 5 which are, for example, formed because the medium conducted through the housing 2, transverse to the tubes 3, is not completely removed through the outlets 18 and noncondensable gas cushions, in the form of bubbles or the like, can as a result form on the tube conduits 3 or on the partitions 4. These residues can act as an insulator in a disadvantageous manner, and can cause a performance loss of up to 50%.

To avoid this drawback, a venting tube 6 is provided, according to the invention, which preferably projects through all sections 5 of the housing 2 and has a number of venting holes formed transversely to the longitudinal extension 14 of the tube 6. Any fluid residues forming in the housing 2 can be suctioned off via this venting tube 6 and be released to the area surrounding the heat exchanger 1. The use of the venting tube 6 consequently creates the possibility of freeing the housing 2 of the heat exchanger 1 from any fluid residues, thus ensuring a comparatively high efficiency with increasing operation time of the heat exchanger 1.

The embodiment according to FIG. 1 shows a heat exchanger 1 according to the invention with a venting tube 6 that has already been inserted by the manufacturer. By contrast, the embodiment according to FIG. 2 shows a heat exchanger 1 equipped with a venting tube in the aforementioned sense. In this embodiment, provision is made for a tube 3, originally provided for heat exchange, to be cut open in the area above the partition 4, located at the bottom in the longitudinal direction 14, at the location designated by 8, and for the severed tube section to be removed and replaced by a venting tube 6 provided with venting holes 15. The remaining partial section 7 of the tube 3 originally provided for heat exchange remains in the heat exchanger 1 and is closed by a stopper 9 at the end. To determine the positions of the partitions 4, arranged within the heat exchanger, an eddy current measurement can be carried out in a preceding process step. The mode of operation of this venting tube 6, introduced subsequently to the heat exchanger 1 as a retrofit, corresponds to that already described for FIG. 1.

To arrange a venting tube 6 as a retrofit, a method is provided, according to the invention, which will be described in more detail with the aid of FIGS. 3-6. In FIGS. 1-6, a partial section of the tube 3, originally provided for heat exchange is shown in schematic partial view in the vicinity of the opening site designated by 8 in FIG. 2. In a first method step, which is shown in FIG. 3, the tube3 originally provided for heat exchange is preferably first opened in the section above the partition situated at the bottom in the longitudinal direction 14. This is schematically shown in FIG. 3 by the opening site 8 indicated with the broken line. After opening of the tube 3, the severed tube section 18 [sic; 1*a*] is then removed from the heat exchanger 1 and replaced by a venting tube 6 provided with venting holes 15. For secure arrangement of the venting tube 6*a*, the partial section 7 of the tube 3 originally provided for heat exchange that remains in the heat exchanger 1 is widened to form a tube holder 16. This tube widening is shown in FIG. 4. As soon as this is done, the venting tube 6 can be pushed into the heat exchanger 1 in a final method step and fitted into tube holder 16. As can be deduced in particular from FIG. 5, the venting tube 6 is constructed closed on the tube holder side, for which purpose a closure element 21 can be provided. For secure arrangement of the venting tube 6, it is inserted into the partial section 7 of the tube 3 remaining in the heat exchanger. Alternately, cementing is also possible.

An alternative embodiment for joining the venting tube 6 with the partial section 7 of the tube 3 remaining in the heat exchanger is shown by FIG. 6. Here, it is shown that a connecting element 20, introduced into the venting tube 6, is provided at the end of the venting tube 6; it can be constructed, for example, in the form of a cylindrical element that tapers on the tube holder side. To joining the venting tube 6 with the partial section 7 of the tube, remaining in the heat exchanger, the venting tube 6 is introduced into the heat exchanger with the connecting element 20 protruding beyond the edge of the venting tube 6 on the tube holder side. This is thus introduced into the tube 3 as a connection between the venting tube 6 and the partial section 7. Use of the connecting element 20 on the one hand effects an arrangement of the venting tube 6 relative to the partial section 7 of the tube 3 that is positionally secure, and on the other hand ensures end sealing of the venting tube 6. For positionally secure arrangement of the partial section 7 of the tube 3, that remains in the heat exchanger, it is formed widened in the area of the partition 4, so that unintended slippage of the partial section 7 of the tube 3 can be effectively prevented.

Alternative to execution of the method as described above, provision can also be made for the tube 3 originally provided for heat exchange to be first widened in the vicinity of the eventual opening site 8, before opening it. What is thus attained is that after opening of the tube has been effected, the partial section 7 of the tube 3 remaining in the heat exchanger does not slip, but rather is maintained secure in its position. After opening of the tube, the tube widening is then used as the tube holder, as already described in the preceding. Execution of a method according to this alternative consequently makes provision such that for retrofitting the venting tube 6, first of all, a tube originally provided for heat exchange is widened preferably above the partition located at the bottom. Then there is a cutting-open of the tube 3 in the area of this widening, in which case, because of the widening, an unwanted slippage of the partial section 7 of the tube 3 remaining in the heat exchanger 1, is stopped. After cutting open the tube 3, the widened end area of the partial section 7 of the tubes is moreover used as a tube holder 16 into which is fitted the venting tube to be introduced into the heat exchanger 1.

LIST OF REFERENCE SYMBOLS

1 Heat exchanger
2 Housing
3 Tube
4 Partition
5 Section
6 Venting tube
7 Partial section
8 Opening site
9 Stopper
10 Flow direction
11 Flow direction
12 Flow direction
13 Flow direction
14 Longitudinal direction
15 Venting hole
16 Tube holder
17 Inlet
18 Outlet
19 Tube section
20 Connecting element
21 Closure element

The invention claimed is:

1. Heat exchanger with a plurality of tubes, brought together to form at least one tubular bundle and located in a housing having a width, and several partitions, wherein said partitions extend the entire width of the housing, subdividing the housing into separate, enclosed, individual sections, characterized by a venting tube, preferably extending through all sections of the housing and having a number of venting holes formed transversely to the longitudinal extension of the tube.

2. Heat exchanger according to claim 1, characterized in that the venting tube has at least one venting hole per separate section.

3. Heat exchanger according to claim 1, characterized in that the venting tube extends to the partition of the section located at the bottom in the longitudinal direction.

4. Heat exchanger according to claim 1, characterized in that it has a plurality number of venting holes.

* * * * *